United States Patent [19]

Schneider

[11] 4,084,738

[45] Apr. 18, 1978

[54] CARRIER FOR AUTOMATIC NAILER

[76] Inventor: Fredric H. Schneider, 4521 Merrill Ave., Oakland, Calif. 94619

[21] Appl. No.: 745,570

[22] Filed: Nov. 29, 1976

[51] Int. Cl.[2] ..... B27F 7/02

[52] U.S. Cl. ..... 227/7; 227/8; 227/111

[58] Field of Search ..... 227/5, 6, 7, 8, 110, 227/111

[56] References Cited

U.S. PATENT DOCUMENTS

| | | | |
|---|---|---|---|
| 3,796,365 | 3/1974 | Downing | 227/111 |
| 3,984,040 | 10/1976 | Fry | 227/111 |

*Primary Examiner*—Granville Y. Custer, Jr.
*Attorney, Agent, or Firm*—C. Michael Zimmerman

[57] ABSTRACT

A carrier for converting a hand nailer gun of the type used in frame building construction to an automatic nailing mechanism is described. The carrier includes a carriage for a hand nailer gun, and a frame which supports the carriage for movement along a construction surface. A motion sensing wheel engages any construction surface over which the carrier travels to reciprocate the hand nailer gun against the same and thereby periodically actuate a trigger plunger at the nail discharge port of the gun. Alternative mechanism is included for either automatically depressing the trigger finger to discharge the gun or to provide an operator with direct control of such discharge. Moreover, a safety blocking arrangement is included to prevent depression of the finger trigger except under controlled circumstances.

24 Claims, 7 Drawing Figures

CARRIER FOR AUTOMATIC NAILER

BACKGROUND OF THE INVENTION

The present invention relates to frame building construction and, more particularly, to a carrier for an automatic nailer of the type used, for example, to nail floor planking to support joists.

Hand nailer guns which are driven automatically, e.g., pneumatically, are now commonly used in frame building construction to nail the boards making up an underflooring to underlying support joists. Typically such guns include a nail magazine which sequentially feeds nails to a discharge port for driving into boards or the like to be nailed. The driving mechanism is generally operated by a separate air source, and the nailer gun includes a hand grip having an actuating finger trigger for operating the same. Because serious injuries can be caused by the accidental discharge of such a gun, most modern hand nailer guns have a discharge port plunger which must be depressed by, for example, pressing the discharge port against lumber to be nailed, before depression of the finger trigger will cause the gun to fire. The newest guns require that the safety trigger plunger at the nail discharge port be separately depressed simultaneously with the actuation of the finger trigger each time the gun is to be fired. This prevents the safety plunger from being defeated by being continuously held in a depressed condition.

While automatic hand nailer guns of the type described are a vast improvement over traditional hammers, they still leave much to be desired. They are generally heavy and require a workman to be bent over to operate the same. It will be recognized that after several hours of such bending over and operation of a heavy nailer gun, a workman will be both tired and sore.

SUMMARY OF THE INVENTION

The present invention relates to a carrier for an automatic nailer which is particularly adapted to convert hand nailer guns to a simple "wheelbarrow" arrangement. Moreover,it provides automatic discharge of the gun in a quite safe manner.

In its basic aspects, the carrier of the invention includes a carriage for an automatic nailer which positions the same with its nail discharge port facing and closely adjacent a construction surface on which it is desired receive nails; a frame supporting the carriage for movement along the construction surface, which frame has a pair of handles projecting therefrom with hand grips to be grasped by a workman; and means to trigger discharge of the automatic nailer. Most desirably, the carriage is adapted to be used with a hand nailer gun and, in this connection, the carriage preferably includes means for holding the hand nailer gun which permits the gun to be selectively released from the carriage. Moreover, the carrier preferably is adapted to operate automatically all the different variations of safety plunger mechanisms. In this connection, means are most desirably provided for periodically reciprocating the carriage and any nailer gun held thereby to actuate the trigger plunger at the nail discharge port of the gun. Moreover, the automatic triggering arrangement for the gun includes a motion sensing wheel which engages the construction surface to be rotated thereby as the carriage moves the gun between different locations, and means are responsive to such rotation of the motion sensing wheel by periodically operating the finger trigger of the hand nailer gun.

The carrier of the invention includes many other features and advantages which will be described or will become apparent from the following more detailed description of the preferred embodiment.

BRIEF DESCRIPTION OF THE DRAWINGS

With reference to the accompanying three sheets of drawing.

DETAILED DESCRIPTION OF THE PREFERRED EMBODIMENT

Figure 1:
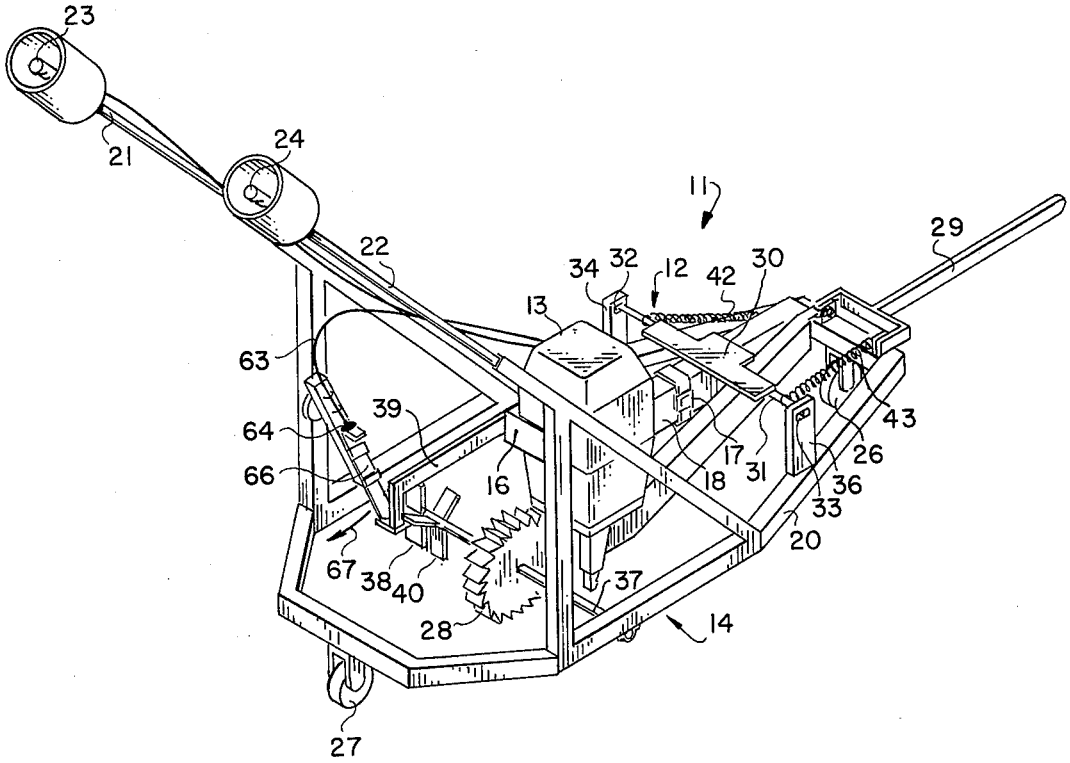
FIG. 1 is an overall isometric view of a preferred embodiment of the carrier of the invention illustrating the same holding a hand nailer gun in position.

A preferred embodiment of the carrier of the invention is generally referred to in the accompanying figures by the reference numeral 11. Such carrier has basically two main components: a carriage 12 which supports a hand nailer gun 13 and a frame 14 which supports the carriage for movement along a construction surface.

The means on the carriage for holding a hand nailer gun is simply a framework 16 defining a cavity receiving the body of such gun, and a releasable strap 17 which secures the hand grip 18 of the gun 13 to an arm 19 of the carriage 12. It will be appreciated that with this arrangement, the hand nailer gun 13 can be selectively released from the carriage merely by freeing the strap 17. Once such strap is freed, the gun can be removed from the framework 16 for use separate and apart from the carrier.

Frame 14 which supports the carriage 12 and, hence, the hand nailer gun 13 is designed for movement along a construction surface between the locations at which nails are to be driven. In this connection, it will be seen that the frame 14 includes a peripheral box framework 20 surrounding the carriage from which a pair of handles 21 and 22 project. Handles 21 and 22 are each provided with a hand grip 23 and 24, respectively. Front and rear support wheels 26 and 27, and a motion sensing wheel 28 depend from the peripheral framework 20 for engagement with a construction surface in a manner to be discussed. With this construction, the carrier can be moved along a construction surface by a workman pushing the same. As is apparent from the drawing, the wheels 26, 27 and 28 are substantially in alignment with both the nail discharge port of the nailer gun and the direction of travel of the carrier over the construction surface so that the carriage is tiltable in a direction transverse to such direction of travel without changing the location of the nail discharge port relative to the construction surface. A pointer 29 extends from the front end of the frame opposite the end from which the handles 21 and 22 project. Such pointer is alignable with a chalk line or other indication on the construction surface of the direction in which the carrier is to be moved therealong between the locations at which nails are desired.

The carrier of the invention is arranged to automatically fire the hand nailer gun at a plurality of locations spaced selectively along its path of travel over a construction surface. In pursuit of such automatic firing, the carrier is arranged to periodically operate a trigger plunger at the nail discharge port of a gun. In this connection, means are provided for periodically reciprocating the carriage and hand nailer gun relative to the construction surface. That is, the carriage is pivotally connected to the frame by having an axle 31 rigidly secured to the plate 30 of the carriage extend generally horizontally with respect thereto and have its opposite ends received within slots 32 and 33 adjacent the upper end of standards 34 and 36, respectively. As illustrated, the standards 34 and 36 project upwardly from the peripheral framework 20 of the frame 14 on opposite sides of the carriage. This pivotal connection enables the carriage to be oscillated up and down with respect to the construction surface to depress any trigger plunger at the nail discharge port of the gun by engaging the same with the construction surface over which the carrier travels.

As mentioned previously, the motion sensing wheel 28 engages the construction surface and is rotated thereby as the carrier is moved along such surface. In this connection, the sensing wheel 28 is mounted on an axle 37 which, in turn, is journalled for rotation on the peripheral framework 20 on opposite sides of the carriage. It should be noted in passing that whenever it is desired to move the carriage without the motion sensing wheel 28 engaging the surface over which it is traveling, the carriage can be rocked forward or backward to ride on either of the wheels 26 or 27 as desired.

Means are provided responsive to rotation of the motion sensing wheel 28 for reciprocating the carriage 12. That is, a paddle wheel 38 is mounted on axle 37 for rotation therewith and, hence, for rotation by the motion sensing wheel 28. A motion follower arm 39 is rigidly connected to the carriage and projects outwardly therefrom for engagement with the paddles of the paddle wheel 38 as it rotates. The dimensional and positional relationships of the carriage, follower arm and paddle wheel are such that as the paddle wheel rotates, the arm and, hence, the carriage will be periodically lifted from a position in which the gun's trigger plunger will be depressed by engagement with any construction surface over which the carriage travels to a position in which it is lifted from such construction surface to allow the trigger plunger to extend.

Figure 2:
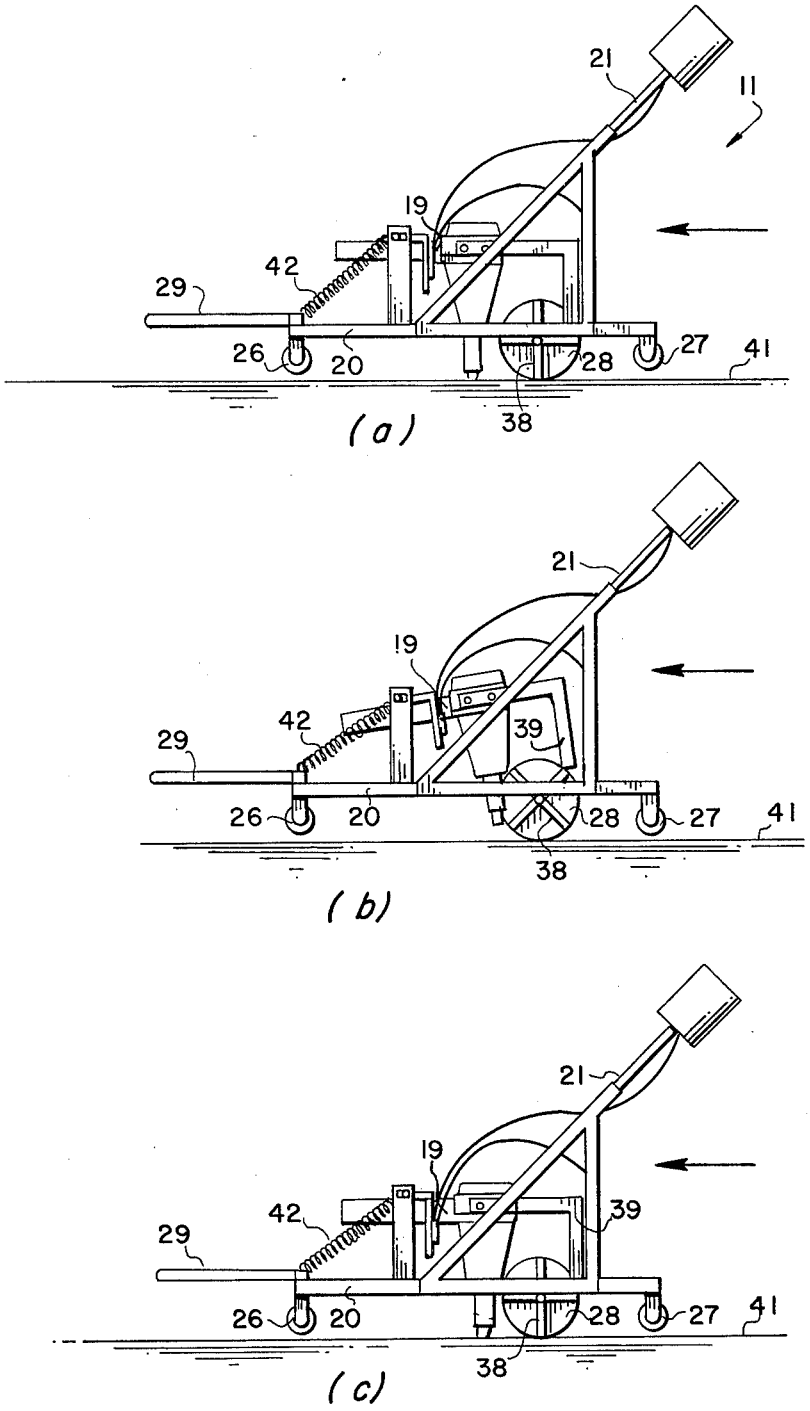
FIGS. 2(*a*) through 2(*c*) are sequential side elevational views of the embodiment of FIG. 1 schematically illustrating its operation during movement over a construction surface.

FIGS. 2 (*a*)–2 (*c*) are three sequential side schematic views showing this operation. FIG. 2 (*a*) illustrates the carriage in a lower position in which the nail port discharge plunger engages the construction surface represented at 41 and is depressed thereby. As the carrier continues to be moved along the construction surface 41, the paddle wheel 38 will be rotated by the motion sensing wheel 28 and raise the arm 39 engaging one on its paddles. The result will be that the carriage will be pivoted upwardly about the axle 31 to disengage the trigger plunger from the surface and, hence, "cock" the same. As the carrier continues its movement along the surface 41, the paddle of the paddle wheel which had been in engagement with the arm 39 travels past the end of the same so that the arm and carriage will be allowed to move downward into the position shown in FIG. 2 (*c*) in which the trigger plunger again engages the construction surface and is depressed thereby. It is at such time that the trigger of the hand gun is fired by one of the means discussed below to discharge a nail from the gun discharge port.

The distance between locations at which the hand nailer gun is actuated by the reciprocal action is dependent on the number of times the gun is reciprocated during each rotation of the motion sensing wheel 28. The number of times is, in turn, determined by the number of paddles on the paddle wheel which engages the arm 39. The paddle wheel 38 which is illustrated engaging such arm has four paddles. In order to facilitate varying the distance between nailing locations, a second paddle wheel 40 (FIG. 1) is also mounted on the shaft 37 for rotation therewith. If the spacing represented by the second paddle wheel 40 is desired, the paddle wheels 38 and 40 are laid axially along the shaft 37 to disengage the paddle wheel 38 from the arm 39 while placing the paddle wheel 40 in position for engagement with such arm. It will be recognized that if additional or different spacings are desired, other paddle wheels can be placed on the axle 37.

It will be appreciated that the movement of the hand nailer gun along construction surface 41 may be temporarily interrupted at the time a nail is discharged therefrom. That is, the head of a discharged nail may interact with the trigger plunger or port shield to snag or catch the gun and prevent the same from moving for a limited time. The carrier of the invention is designed to accommodate such limited interruptions in the movement of the carriage without the full carrier movement also being interrupted. That is, the slots 32 and 33 in the standards which support the axle 31 of the carriage extend in the direction of movement of the carrier. Thus, the carriage and any hand gun held thereby are permitted limited movement relative to the frame in the direction of carrier motion. A pair of coil springs 42 and 43 are secured in tension between the axle 31 and the front of the peripheral framework 20 to urge the carriage forwardly into a normal forward position. Because the hand nailer gun is therefore typically at its most forwardly position relative to the remainder of the carrier, whenever the rate at which such gun travels over the construction surface is interrupted, the full length of the slots 32 and 33 are available to allow continued forward movement of the carrier without interruption.

On some occasions, the limited relative movement between the carriage and the remainder of the carrier allowed by the slots 32 and 33 is not sufficient to accommodate the full interruption of movement of the gun caused by catching on a nail head or the like. The positioning of the pivot axis of the carriage relative to the nail discharge port of the gun prevents such an interruption from interrupting the continuous motion of the whole carrier. That is, the pivot axis of the carriage defined by the axle 31 is generally parallel to the construction surface and forwardly of the nail discharge port of the gun. Thus, any obstruction at the nail discharge port which tends to stop the movement of the carriage will act as a lever to pivot the gun upwardly to free itself from such obstruction. Tension springs 42 and 43 will absorb the abruptness of the discharge port being immediately stopped and thus alleviate the shock accompanying the same which otherwise would be transmitted to the operator. It will be seen from the above that the combination of the location and orientation of the pivot connection with the axle-slot construction allows an operator to push the carriage smoothly over a construction surface in spite of any interruption of the movemnt of the gun due to a "hang-up" of its nail discharge port.

Figure 3:
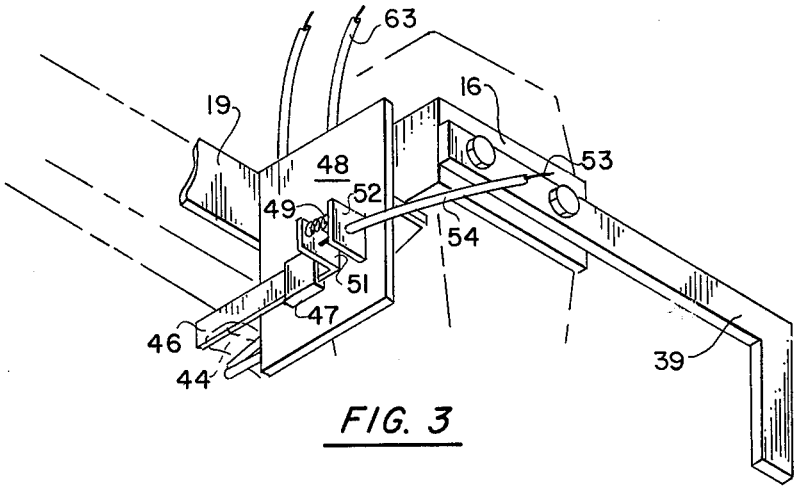
FIGS. 3 and 4 are isometric views illustrating the mechanism of the preferred embodiment which cooperates with the trigger of a hand nailer gun to operate the same.
Figure 4:
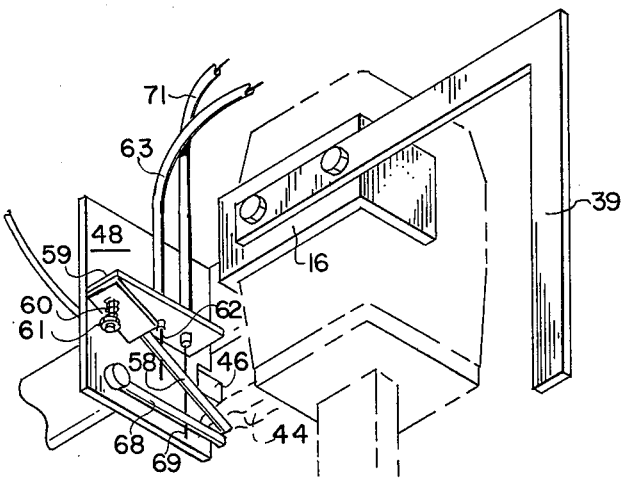
Figure 5:
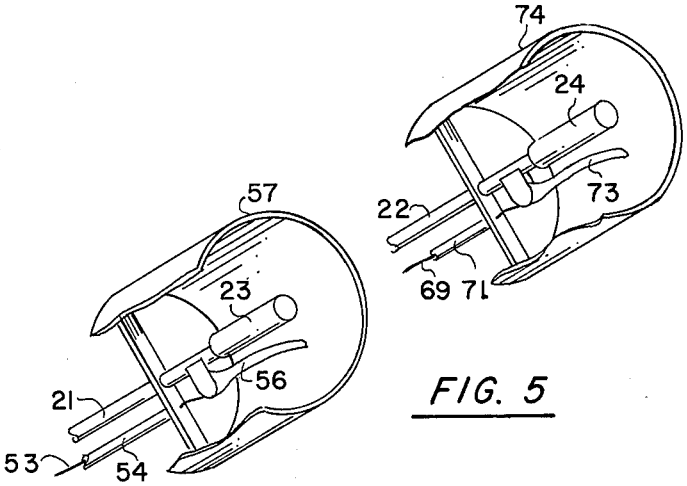
FIG. 5 is a partial isometric view of the handles of the preferred embodiment of the carrier illustrating the hand actuators and safety cuffs therefor.

In order to fire or, in other words, discharge the normally hand-held gun 13, the finger trigger 44 (FIGS. 3 and 4) thereof, must be depressed. The carrier of the invention includes a safety block arrangement which prevents unintentional depression of such finger trigger, as well as both automatic and hand-operated mechanisms for depressing such trigger finger. The blocking arrangement includes an obstruction plunger 46 (FIG. 3) mounted for sliding movement by a bearing collar 47 on the front face of a mounting plate 48 on the carriage. The obstruction plunger 46 is normally urged to the position illustrated behind the finger trigger 44 by a coil spring 49 placed in compression between an end flange 51 of the obstruction plunger and flange 52 projecting from the plate 48. The end flange 51 of the obstruction plunger is connected to a motion transmitting cable 53 which extends coaxially through a protective sheath 54. Such cable and sheath terminate in a hand operated actuator 56 adjacent the grip 23 on the handle 21 (FIG. 5). Depression of the actuator 56 will pull the cable 53 and, hence, withdraw the obstruction plunger against the force of the spring 49 from behind the trigger finger. Thus, it is only when the blocking arrangement provided by the above construction is actuated that the hand nailer gun 13 can be discharged.

It should be noted that a safety shield in the form of a cylindrical cup 57 surrounds the grip 23 and actuator 56 and prevents access to the actuator except from that direction normally taken by the hand of a workman grasping the grip of the handle to move the carrier along a construction surface. This will make it more difficult for a workman to actuate the obstruction plunger when the gun is not actually being used to nail a construction surface, as well as prevent accidental depression of the actuator by its striking an object.

The automatic trigger arrangement is designed to periodically operate the finger trigger as the carrier is moved along a construction surface. Such arrangement includes a trigger bar 58 (FIG. 4) positioned with its free end engaging the trigger 44 and its other end pivotally mounted to a shelf 59 on the rear face of the mounting plate 48. Bar 58 is normally urged in a direction in which it will depress the finger trigger whenever the obstruction plunger 46 is withdrawn. More specifically, a coil spring 60 is placed in compression between the bar 58 and a bolt head 61 on the side of the bar 58 opposite the shelf 59 to urge the bar pivotally toward such shelf and, hence, against the trigger finger 44.

The trigger bar 58 is operatively connected to the motion sensing wheel to be periodically operated thereby. That is, a cable 62 has one end connected to the trigger bar and extends through a sheath 63 to a push knob 64 at its other end. The knob 64 is positioned to be engaged by a plunger 66 which is, in turn, positioned to be driven by the paddles of the paddle wheel 38 as the motion sensing wheel rotates. More particularly, the plunger 66 is positioned to be driven by the same paddle of the paddle wheel that engages the arm 39 of the carriage. As the paddle wheel turns and raises the arm 39 and the carriage, the plunger 66 will be simultaneously driven upward to engage the knob 64 and drive the cable 62 in a direction which urges the bar 58 downward to release the trigger 44 and allow the same to be cocked. Thus, when the carriage is allowed to pivot downward by the arm 39 being released by the paddle of the paddle wheel 38 with which it is engaged, the trigger finger will again be depressed to cause the gun to be fired at such time.

There may be instances in which it is desired that the firing of the nailer gun be under the direct control of the operator, rather than be automatically controlled by travel of the carrier over a construction surface. The automatic firing mechanism of the gun can be simply deactivated by pivoting the holder for the plunger 66 in the direction of the arrow 67 (FIG. 1). This will disengage the plunger from the padde wheel and prevent the same from being actuated by the paddles of such wheel as it rotates. The operator controlled firing mechanism includes a striker 68 which is pivotally mounted on the rear face of the mounting plate 48 with its free end positioned to depress the finger trigger 44 upon being pivoted. Pivoting of the striker is controlled by a cable 69 which passes through a sheath 71 to a hand operated actuator 73 adjacent the grip 24 on the handle 22. When the actuator 73 is depressed, the striker 68 will be pivoted upward to depress the finger trigger 44 for firing the hand nailer gun. It should be noted that when the hand gun is of a type requiring depression of a discharge plunger before it will fire, depression of actuator 73 will fire the gun only when such plunger is also depressed by, for example, the construction surface. A safety shield in the form of a cup 74 similar to the cup 57 protects actuator 73 in the same manner as cup 57 protects actuator 56.

It will be appreciated that the carrier of the invention is quite versatile. Because the wheels of the carrier are in alignment with the gun nail discharge port as well as with the direction of travel of the carrier, toenailing with the gun can be achieved simply by tilting the carriage transverse to its direction of travel. Moreover, while the carrier is capable of being used with the most recently available hand nailer guns which require simultaneous actuation of both a nail discharge port trigger plunger and the trigger finger, it can also be used effectively with the older types of guns. If the gun with which it is desired to use the carrier is one having a trigger plunger but not requiring that the same be separately actuated each time it is desired the gun to be fired, an operator could, if desired deactivate the reciprocal motion of the carriage merely by removing the arm 39 which coacts with the paddle wheel to provide such reciprocation. The hand nailer gun 13 will then continually bear down against the construction surface with the result its trigger plunger will be actuated at all times. It is preferred, however, that the reciprocating action be utilized with this kind of gun in order to reduce the likelihood of the gun becoming "hung-up" by the nail discharge port striking obstructions. The carrier of the invention could likewise be used with hand nailer guns of the type not having trigger plungers at the nail discharge port.

While the carrier of the invention has been described with a preferred embodiment thereof, it will be appreciated by those skilled in the art that various changes and modifications can be made. For example, although it is designed to convert hand nailer guns into automatic nailing machines, it will be recognized that many of its features could be useful as part of a nailing machine which includes nailing mechanism as an integral part thereof. It is therefore intended that the coverage afforded applicant be limited only by the language of the claims and its equivalent.

I claim:

1. A carrier for an automatic hand nailer gun of the type in the construction of buildings comprising a carriage having means to hold a hand nailer gun on said carriage with its nail discharge port facing and closely adjacent a construction surface it is desired receive nails at a plurality of locations; a frame having means supporting said carriage for movement along said construction surface between said locations, said frame having a pair of handles projecting therefrom with a hand grip on each to be grasped by a workman moving said frame and carriage along said construction surface; means to trigger discharge at said plurality of locations of a hand nailer gun held on said carriage; and wheel means on said frame engageable with said construction surface to support the weight of said carrier for movement therealong, said wheel means being substantially in alignment with said nail discharge port and the direction of travel of said carrier over said construction surface whereby said carrier is tiltable about said wheel means in a direction transverse to said direction of travel while said nail discharge port is maintained closely adjacent said construction surface to permit toenailing with said gun.

2. A carrier according to claim 1 wherein said means to hold a hand nailer gun on said carriage is adapted to selectively release from said carriage a gun so held.

3. A carrier according to claim 1 adapted to cooperate with a hand nailer gun having a finger trigger and wherein said means to trigger discharge at said plurality of locations of such a hand nailer gun held by said carriage includes a striker positioned to depress said finger trigger upon actuation and a hand operated actuator for said striker on one of said handles adjacent the grip thereof.

4. A carrier according to claim 1 further including support wheels on said frame engageable with a construction surface to facilitate movement therealong of said frame and carriage.

5. A carrier according to claim 1 wherein said pair of handles project from one end of said frame and further including at the end of said frame opposite the end from which said handles project a pointer alignable with an indication of said construction surface of the direction at which said carrier is to be moved therealong between said locations.

6. A carrier according to claim 1 further including blocking means which until actuated prevent discharge of a hand nailer gun held by said carriage.

7. A carrier according to claim 6 adapted to cooperate with a hand nailer gun having a finger trigger wherein said blocking means comprises an obstruction plunger normally urged to a position behind said finger trigger to prevent the same from being depressed, and a hand operated actuator on one of said handles adjacent the grip thereof operably connected to said obstruction plunger to withdraw the same from its finger trigger blocking position upon actuation of said actuator.

8. A carrier according to claim 1 wherein said means of said frame supporting said carriage is adapted to allow limited relative movement between said frame and said carriage in the direction of movement of said carriage, accommodating limited relative variations in the rate at which said frame and carriage travel over said construction surface.

9. A carrier according to claim 8 wherein said means of said frame supporting said carriage for movement along said construction surface between said locations includes a pivot connection between said frame and carriage having a pivot axis generally parallel to said construction surface positioned forwardly of the location at which the nailer discharge port of a hand nailer gun on said carriage faces said construction surface, and means at said pivot connection enabling limited relative movement between said frame and carriage in the direction in which said carrier travels along said construction surface to accommodate temporary interruptions of the movement of said carriage with said frame during discharge of a nail from a hand nailer gun held on said carriage.

10. A carrier according to claim 9 further including means for periodically reciprocating said carriage and any hand nailer gun held thereby relative to said construction surface for actuating at each of said plurality of locations a trigger plunger at the nail discharge port of said gun.

11. A carrier according to claim 1 wherein said means to trigger discharge at said plurality of locations of a hand nailer gun held by said carriage includes a motion sensing wheel engageable with said construction surface and rotated thereby as said carriage moves between said locations, and means responsive to rotation of said motion sensing wheel by periodically operating a finger trigger on a hand nailer gun held on said carriage.

12. A carrier according to claim 11 wherein said means responsive to rotation of said motion sensing wheel by periodically operating a finger trigger on a hand trailer gun held on said carriage includes a trigger bar positioned to engage and depress said trigger finger, a plunger operatively connected to said trigger bar for actuating the same upon being driven, and an actuating wheel connected to said motion sensing wheel for periodically driving said plunger at a rate correlated to the rate of rotation of said motion sensing wheel.

13. A carrier according to claim 12 wherein said trigger bar is normally urged into a position depressing the finger trigger of a hand nailer gun held by said carriage, and said plunger is responsive to being driven by said actuating wheel by periodically urging said bar in a direction releasing said trigger to cock the same.

14. A carrier according to claim 11 further including at least one support wheel on said frame engageable with a construction surface to support the weight of said carrier for movement thereof along said construction surface when said motion sensing wheel is disengaged therefrom.

15. A carrier according to claim 11 further including means for periodically reciprocating said carriage and any hand nailer gun held thereby relative to said construction surface at each of said plurality of locations to actuate thereat a trigger plunger at the nail discharge port of said gun.

16. A carrier according to claim 15 wherein said means of said frame supporting said carriage for movement along said construction surface between said locations includes a pivot connection between said frame and carriage having a pivot axis generally parallel to said construction surface positioned forwardly of the location at which the nail discharge port of a hand nailer gun on said carriage faces said construction surface.

17. A carrier according to claim 15 further including blocking means which until actuated prevents discharge of a hand nailer gun held by said carriage.

18. A carrier according to claim 17 adapted to cooperate with a hand nailer gun having a finger trigger wherein said blocking means comprises an obstruction plunger normally urged to a position behind said finger trigger to prevent the same from being depressed, and a hand operated actuator on one of said handles adjacent the grip thereof operably connected to said obstruction plunger to withdraw the same from its finger trigger blocking position upon actuation of said actuator.

19. A carrier according to claim 18 further including a safety shield surrounding said hand operated actuator on said handle preventing access to said actuator except from a direction normally taken by the hand of a workman grasping said grip of said handle to move said carrier along said construction surface.

20. A carrier according to claim 19 wherein said means to trigger discharge at said plurality of locations of such a hand nailer gun held by said carriage includes a striker positioned to depress said trigger finger upon actuation, and a hand operated actuator for said striker on the other of said handles adjacent the grip thereof; and a safety shield is provided surrounding said hand operated actuator on said other handle preventing access to said actuator except from a direction normally taken by the hand of a workman grasping said grip of said other handle to move said carrier along said construction surface.

21. A carrier for an automatic nailer of a type used in the construction of buildings comprising a carriage for an automatic nailer positioning the same with its nail discharge port facing and closely adjacent a construction surface it is desired receive nails at a plurality of locations; a frame having means supporting said carriage for movement along said construction surface between said locations, said frame having a pair of handles projecting therefrom with a hand grip on each to be grasped by a workman moving said frame and carriage along said construction surface; means to trigger discharge at said plurality of locations on an automatic nailer held by said carriage; and wheel means on said frame engageable with said construction surface to support the weight of said carrier for movement therealong, said wheel means being substantially in alignment with said nail discharge port and the direction of travel of said carrier over said construction surface whereby said carrier is tiltable about said wheel means in a direction transverse to said direction of travel while said nail discharge port is maintained closely adjacent said construction surface to permit toenailing with said gun.

22. A carrier according to claim 21 wherein said means to trigger discharge at said plurality of locations of an automatic nailer held by said carriage includes a motion sensing wheel engagable with said construction surface and rotated thereby as said carriage moves between said locations, and means responsive to rotation of said motion sensing wheel for periodically actuating discharge of an automatic nailer on said carriage.

23. A carrier according to claim 22 wherein said means responsive to rotation of said motion sensing wheel for periodically actuating discharge of said automatic nailer includes a plunger operatively connected to said automatic nailer for actuating the same upon being driven, and an actuating wheel connected to said motion sensing wheel for periodically driving said plunger at a rate correlated to the rate of rotation of said motion sensing wheel.

24. A carrier according to claim 22 further including means for periodically reciprocating relative to said construction surface at each of said plurality of locations, said carriage and an automatic nailer gun thereon to actuate a trigger plunger at the nail discharge port of said gun.

* * * * *